US011685183B2

(12) United States Patent
Talmadge

(10) Patent No.: US 11,685,183 B2
(45) Date of Patent: Jun. 27, 2023

(54) CLIPBOARD APPARATUS

(71) Applicant: Michelle Talmadge, Fountain Valley, CA (US)

(72) Inventor: Michelle Talmadge, Fountain Valley, CA (US)

(73) Assignee: ScratchCatcher LLC, Huntington Beach, CA (US)

( * ) Notice: Subject to any disclaimer, the term of this patent is extended or adjusted under 35 U.S.C. 154(b) by 0 days.

(21) Appl. No.: 17/674,531

(22) Filed: Feb. 17, 2022

(65) Prior Publication Data

US 2022/0258524 A1 Aug. 18, 2022

Related U.S. Application Data

(60) Provisional application No. 63/150,291, filed on Feb. 17, 2021.

(51) Int. Cl.
*B42F 9/00* (2006.01)
*A63F 3/06* (2006.01)

(52) U.S. Cl.
CPC ..... *B42F 9/002* (2013.01); *A63F 3/068* (2013.01); *B42F 9/00* (2013.01); *B42F 9/001* (2013.01)

(58) Field of Classification Search
CPC ..... B42D 9/00; B42D 9/001; B42D 9/002; A63F 3/068; B42F 9/00; B42F 9/001; B42F 9/002
USPC ..... D19/88
See application file for complete search history.

(56) References Cited

U.S. PATENT DOCUMENTS

| | | | | | |
|---|---|---|---|---|---|
| 3,048,424 | A * | 8/1962 | Mitchell, Jr. | B42F 9/001 | 281/31 |
| D316,727 | S * | 5/1991 | Greenspahn | D19/113 | |
| 10,729,971 | B1 * | 8/2020 | Lengyel | A63F 3/068 | |
| 2011/0127180 | A1 * | 6/2011 | Vogias | A63F 3/068 | 206/39 |
| 2013/0247358 | A1 * | 9/2013 | Watson | A63F 3/068 | 29/559 |
| 2014/0312194 | A1 * | 10/2014 | Segura | B42F 9/001 | 248/451 |
| 2015/0034799 | A1 * | 2/2015 | Krapf | B42F 9/002 | 248/452 |
| 2015/0151193 | A1 * | 6/2015 | Sartini | A63F 3/068 | 273/309 |
| 2019/0247742 | A1 * | 8/2019 | Edwards | A63F 3/068 | |
| 2021/0394044 | A1 * | 12/2021 | Martin | A63F 3/068 | |

* cited by examiner

*Primary Examiner* — Kyle R Grabowski
(74) *Attorney, Agent, or Firm* — Barry Choobin; Patent 360

(57) ABSTRACT

A clipboard apparatus for holding lottery tickets and collecting shavings from the lottery tickets. The clipboard apparatus has a base having a flat top surface and a bottom surface, the base has a proximal end and a distal end. A clip is coupled to the top surface of proximal end of the base, wherein the clip can secure one or more lottery tickets held on the base. A receptacle is at the top surface of distal end of the base, the receptacle has an open top, the open top of the receptacle faces towards the clip, wherein the receptacle can receive and hold the shavings scratched from the lottery ticket.

6 Claims, 2 Drawing Sheets

CLIPBOARD APPARATUS

CROSS-REFERENCE TO RELATED APPLICATIONS

This application claims priority to the U.S. provisional patent application Ser. No. 63/150,291 filed on 17 Feb. 2021, which is incorporated herein by reference in its entirety.

FIELD OF INVENTION

The present invention relates to a clipboard apparatus for holding planar articles, and more particularly, the present invention relates to an apparatus for holding planar articles and a built-in receptacle for collecting shavings scratched from a planar article.

BACKGROUND

Clipboards are well known for holding a sheet of paper or a stack of papers. The clipboards generally have a rigid board and a clip coupled to the rigid board. The rigid board can provide support to a sheet of paper such that to write on the paper. The clip can hold the sheet or sheets of paper in place while carrying or mounting the clipboard, or while writing on a paper clamped on the clipboard.

Often a need arises to scratch or cut a paper, cardboard, and the like planar article. For example, lottery tickets need to be scratched. While scratching a lottery ticket, the lottery ticket must be kept upright and stable. A clipboard can be used to keep the lottery ticket stable, however, the shavings from the scratching of the lottery ticket fall on the clothes of a person holding the lottery ticket. Moreover, the shavings get scattered all over the floor which looks messy and often annoying. A need is therefore appreciated for a device to solve the aforesaid problem.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a clipboard apparatus for stably holding a planar article.

It is another object of the present invention that the clipboard apparatus allows collecting the shavings scratched from a planar article.

It is another object of the present invention that the apparatus can hold a scratching tool.

In one aspect, disclosed is a clipboard apparatus comprising a base having a top surface and a bottom surface, the base has a proximal end and a distal end; a clip coupled to the top surface of proximal end of the base, wherein the clip is configured to secure one or more planar articles held on the base; and a receptacle at the top surface of distal end of the base, the receptacle has an open top, the open top of the receptacle faces towards the clip, wherein the receptacle is configured to receive and hold shavings scratched from a planar article of the one or more planar articles. The receptacle extends edge to edge of the base. An inner surface of the receptacle is continuous with the top surface of the base. The clipboard apparatus further comprises a pocket at the bottom surface of the base, the pocket configured to receive and hold the one or more planar articles. The one or more planar articles comprise sheets of paper. The one or more planar articles comprise lottery tickets. The bottom surface of the proximal end of the base has a U-shape hook. The proximal end of the base extends rearwards and downwards to form the U-shape hook, such that the base and the U-shape hook are integral, and the top surface of the base and the bottom surface of the base are continuous with top and bottom surfaces of the U-shape hook. An outer flange of the U-shape hook is further curved outwards to form a bracket, wherein the bracket is configured to hold a scratching tool. The bracket has a snap fit mechanism to secure the scratching tool. The clipboard apparatus further comprises the scratching tool, the scratching tool has one tip configured to scratch a planar article of the one or more planar articles and another tip of the scratching tool has brushes.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
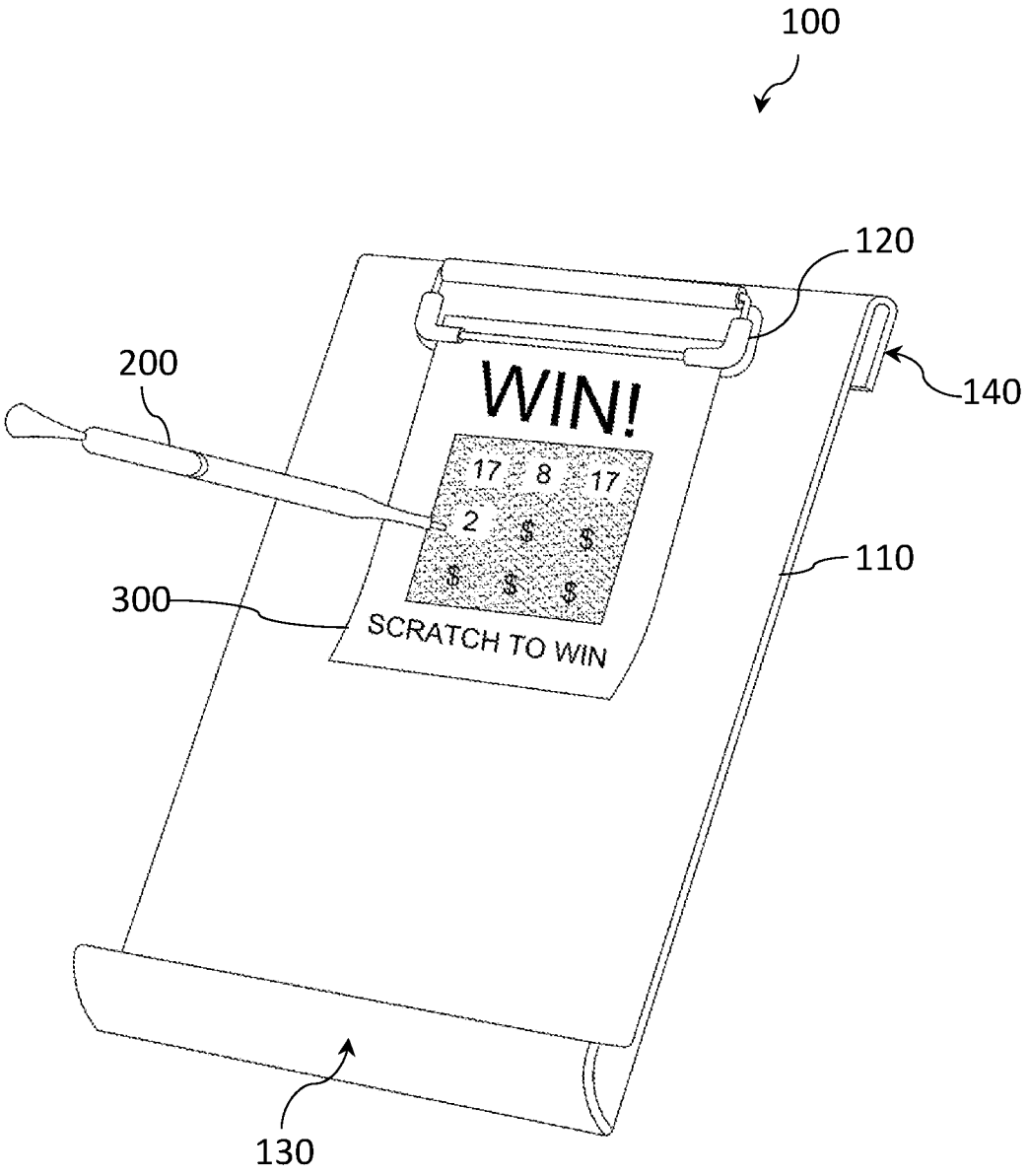
FIG. 1 is a front and side perspective view of the clipboard apparatus showing a board, a clip, and an integral receptacle according to an exemplary embodiment of the present invention.
Figure 2:
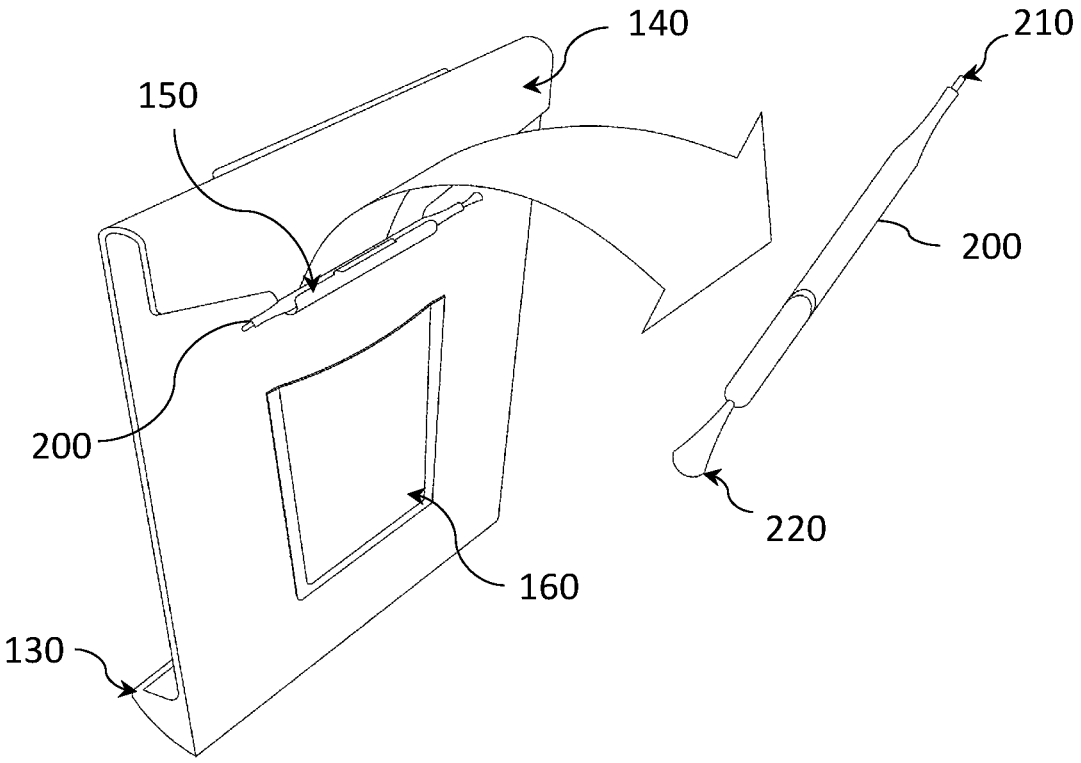
FIG. 2 is a rear and side perspective view of the clipboard apparatus showing a scratching tool, a bracket for holding the scratching tool, and a pouch for holding a planar article, according to an exemplary embodiment of the present invention.

Disclosed is a clipboard apparatus for holding a planar article, such as sheets of paper, lottery tickets, cardboard sheets, and the like. One or more sheets can be held by the disclosed apparatus. The apparatus can include a base 110 that can be made from any rigid material, such as plastic and metal. The rigid base can stably support planar articles, such as lottery tickets. The base can be manufactured in a range of sizes and shapes. In one case, the base can be manufactured according to the shape and size of the planar article. Moreover, the base can be manufactured in distinct colors including being transparent. The base can have a proximal end and a distal end, the proximal end can be at a top of the base and the distal end can be at a bottom of the base. A clip 120 can be provided at the top surface of the proximal end of the base. The clip can clasp the planar article 300, wherein the structure and functioning of the clips for use in clipboards to secure paper sheets are well known, and any such clip can be incorporated without departing from the scope of the present invention. The planar article 300 shown in FIG. 1 is a lottery ticket.

The distal end of the base 110 can be provided with a receptacle 130. FIG. 1 shows a receptacle 130 at the top surface of the distal end of the base, wherein the receptacle has an open-top. The top opening of the receptacle can face upwards, i.e., towards the top surface of the base and the clip. In one case, the inner surface of the receptacle can be continuous with the top surface of the base. The receptacle and the base can be manufactured integrally as a single unit. Alternatively, a separate receptacle can be coupled at the distal end of the base. The receptacle can extend along an entire width of the base. The receptacle can be closed from all sides except the top and can contain the shavings scratched from the planar article. The receptacle can be a U-shape or rectangular shape, and any other shape of the receptacle is within the scope of the present invention.

In use, the planar article, such as a lottery ticket can be put on the base and secured to the base by the clip. Thereafter, the lottery ticket can be scratched, and the shavings can drop into the receptacle. The width of the receptacle could be sufficient to capture the shavings gliding over the base, or dropping directly into the receptacle.

On the bottom surface of the base 110 can be provided a pouch 160 to hold one or more planar articles, such as lottery tickets can be stored in the pouch 160. The tickets can be lottery tickets or similar tickets used in a game and require cutting or scratching specific areas in the ticket.

To the bottom surface of the proximal end of the base 110 can be provided a U-shape hook 140 that allows hanging the disclosed apparatus from a support structure. For example, the apparatus can be hung from the back of the seat. An outer flange of the hook can form a bracket 150 to hold a scratching tool 200. FIG. 1 shows the scratching tool 200 as a pen-like device having a flat scratching head 210 at a tip and a brush 220 at the bottom end of the scratching tool 200. The flathead 210 of the scratching tool 200 can be used to scratch a planar article and the shavings generated from the scratching can be received within the receptacle 130. The brush 220 at the opposite end of the scratching tool 200 can be used to clean the planar article from the shavings. The scratching tool can be removed and mounted again to the snap-fit bracket 150. Other mechanisms, such as magnets are within the scope of the present invention to hold the scratching tool 200. The U-shape hook 140 and the base 110 can be integral to form a single unit. For example, during manufacturing, a U-shape hook can be mounted to the base. Perhaps the base at the top can extend rearward and then downward to form the U-shape hook 140 and the surfaces of the base 110 can be continuous with the surfaces of the hook 140. Moreover, bracket 150 can be integral with hook 140 to form a single unit. As shown in the drawings, the base, the receptacle, the hook, and the bracket can be integrally formed as a single unit.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A clipboard apparatus comprising:

a base having a top surface and a bottom surface, the base has a proximal end and a distal end;

a clip coupled to the top surface of proximal end of the base, wherein the clip is configured to secure one or more planar articles held on the base;

a receptacle at the top surface of distal end of the base, the receptacle has an open top, the open top of the receptacle faces towards the clip, wherein the receptacle is configured to receive and hold shavings scratched from a planar article of the one or more planar articles, wherein an inner surface of the receptacle is continuous with the top surface of the base;

a U-shape hook, wherein the proximal end of the base extends rearwards and downwards to form the U-shape hook, such that the base and the U-shape hook are integral, and the top surface of the base and the bottom surface of the base are continuous with top and bottom surfaces of the U-shape hook; and a bracket, wherein an outer flange of the U-shape hook is further curved outwards to form the bracket, the bracket is configured to hold a scratching tool, the bracket has a snap fit mechanism to secure the scratching tool.

2. The clipboard apparatus according to claim 1, wherein the receptacle extends edge to edge of the base.

3. The clipboard apparatus according to claim 1, wherein the clipboard apparatus further comprises a pocket at the bottom surface of the base, the pocket configured to receive and hold the one or more planar articles.

4. The clipboard apparatus according to claim 1, wherein the one or more planar articles comprise sheets of paper.

5. The clipboard apparatus according to claim 1, wherein the one or more planar articles comprise lottery tickets.

6. The clipboard apparatus according to claim 1, wherein the clipboard apparatus further comprises the scratching tool, the scratching tool has one tip configured to scratch a planar article of the one or more planar articles and another tip of the scratching tool has brushes.

* * * * *